US008274351B2

(12) United States Patent
Kiuchi et al.

(10) Patent No.: US 8,274,351 B2
(45) Date of Patent: Sep. 25, 2012

(54) TRANSFORMER DEVICE

(75) Inventors: Hiroshi Kiuchi, Chiyoda-ku (JP); Koji Kise, Chiyoda-ku (JP); Toshihiro Noda, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/128,063

(22) PCT Filed: Dec. 25, 2008

(86) PCT No.: PCT/JP2008/073581

§ 371 (c)(1),
(2), (4) Date: May 6, 2011

(87) PCT Pub. No.: WO2010/073337

PCT Pub. Date: Jul. 1, 2010

(65) Prior Publication Data

US 2011/0205007 A1 Aug. 25, 2011

(51) Int. Cl.
*H01F 27/02* (2006.01)
*H01F 27/10* (2006.01)

(52) U.S. Cl. ..... 336/94; 336/57; 336/58

(58) Field of Classification Search ..... 336/57, 336/58, 73, 94

See application file for complete search history.

(56) References Cited

U.S. PATENT DOCUMENTS 3,028,566 A * 4/1962 Camilli ..... 336/57
3,362,001 A * 1/1968 Wishman et al. ..... 336/60
3,808,562 A * 4/1974 Weigel et al. ..... 333/172
4,000,482 A * 12/1976 Staub et al. ..... 336/60
4,028,653 A * 6/1977 Carlsson et al. ..... 336/60
5,444,426 A * 8/1995 Sokai ..... 336/57
6,529,108 B2 * 3/2003 Ito et al. ..... 336/57
6,563,410 B1 * 5/2003 Marton ..... 336/55

(Continued)

FOREIGN PATENT DOCUMENTS

JP 59-140419 U 9/1984
JP 60-119726 U 8/1985

(Continued)

OTHER PUBLICATIONS

International Search Report (PCT/ISA/210) for PCT/JP2008/073581 dated Feb. 24, 2009.

*Primary Examiner* — Mohamad Musleh
*Assistant Examiner* — Joselito Baisa
(74) *Attorney, Agent, or Firm* — Buchanan Ingersoll & Rooney PC

(57) ABSTRACT

A transformer device includes an iron core, a plurality of stacked coils, wound onto the iron core, a plurality of base members arranged between the plurality of coils adjacent in a stacking direction, a plurality of flow channel member groups provided for each of the coils, each provided at a corresponding base member, and forming a flow channel directed to a flow of an insulating liquid between the corresponding base member and a corresponding coil, and an obstruction member arranged to obstruct the flow of the insulating liquid such that at least one of the flow channels formed by the plurality of flow channel member groups differs in the flow volume of the insulating liquid from another of the flow channels, and to obstruct the flow of the insulating liquid at a region not overlapping with the iron core in the flowing direction of the insulating liquid, among the flow channels.

10 Claims, 8 Drawing Sheets

U.S. PATENT DOCUMENTS

| | | | | |
|---|---|---|---|---|
| 6,577,027 | B2 * | 6/2003 | Hayase et al. | 310/59 |
| 7,075,198 | B2 * | 7/2006 | Korenaga | 310/12.05 |
| 7,173,424 | B2 * | 2/2007 | Saitoh et al. | 324/318 |
| 7,227,284 | B2 * | 6/2007 | Korenaga | 310/12.25 |
| 7,233,223 | B2 * | 6/2007 | Darmann | 336/180 |

FOREIGN PATENT DOCUMENTS

| | | | |
|---|---|---|---|
| JP | 6-017215 | U | 3/1994 |
| JP | 9-134823 | A | 5/1997 |
| JP | 10-064734 | A | 3/1998 |
| JP | 2004-014817 | A | 1/2004 |

* cited by examiner

TRANSFORMER DEVICE

TECHNICAL FIELD

The present invention relates to a transformer device, particularly a transformer device including a member to form a flow path of an insulating liquid for cooling a coil.

BACKGROUND ART

Generally, a pump for circulation of an insulating liquid and a cooler are employed for lowering the heat generated from the coil of a vehicle transformer. A plurality of insulation members (spacer) are provided between the coils of the transformer. This spacer serves to ensure the flow channel of the insulating liquid flowing to cool the coil, and to retain the coil when mechanical force is generated by shorting.

The capability of cooling the coil is proportional to the coil wet area that is the area of the coil in contact with the insulating liquid, i.e. the surface area of the coil minus the area of the coil in contact with the spacer, and the flow rate of the insulating liquid flowing along the coil surface. Accordingly, the cooling efficiency is improved by ensuring a larger coil wet area.

However, even if a larger coil wet area is ensured by widening the spacer interval, the coil may be buckled to cause damage of the transformer unless the interval is sufficient to withstand the mechanical force, when generated, due to shorting.

The technique of cooling the coil of a transformer is disclosed in, for example, Japanese Patent Laying-Open No. 9-134823 (Patent Document 1) directed to a transformer for a vehicle. Specifically, in oil and air feed cooling system, a low-voltage winding is wound around the perimeter of the leg of an iron core, and a high-voltage winding is wound around the perimeter of the low-voltage winding, forming a cooling oil path between the windings. This structure is disposed in a tank such that the cooling oil path is parallel to the bottom of the tank. Duct pieces are provided between each winding of the low-voltage winding and high-voltage winding at different intervals to form the cooling oil path.

Japanese Patent Utility Model Laying-Open No. 6-17215 (Patent Document 2) discloses a transformer winding, including a stacked layer of a disk winding wound a plurality of stages between inner and outer insulation tubes, and having rectangular spacer pieces forming an oil path between the disk windings of each stage, arranged radially and in plurality. The width dimension of the spacer pieces at the upper end side is sequentially reduced to satisfy the relationship of A>B, where A is the width dimension of the spacer pieces at the center region in the axial direction of the transformer winding, and B is the width dimension of the spacer pieces at an end side located at least at the upper side in the axial direction of the winding.

Patent Document 1: Japanese Patent Laying-Open No. 9-134823

Patent Document 2: Japanese Utility Model Laying-Open No. 6-17215

DISCLOSURE OF THE INVENTION

Problems to be Solved by the Invention

There is developed an AC/DC train capable of running both in an AC zone where AC voltage is supplied from an overhead line or the like and a DC zone where DC voltage is supplied from an overhead line or the like. In the case where the coil of the load side that is the low-voltage side is commonly used in the AC zone and DC zone in such an AC/DC train, i.e. in the case where a low-voltage coil and a converter are connected in an AC zone, and the low-voltage coil is employed as a reactor receiving DC power from an overhead line or the like in the DC zone, the rise in temperature of the low-voltage coil is not equalized since the usage condition and load condition of the low-voltage coil differ between the DC zone and AC zone. For example, the temperature of the low-voltage coil used as a reactor at the DC zone increases significantly. Accordingly, the cooling design of the entire transformer is defined by the coil in part at the transformer. Therefore, the transformer is rendered large in size since it is necessary to use a large cooler having high cooling capability, leading to increase in the fabrication cost.

The vehicle transformer of Patent Document 1 has the cooling oil path formed linearly along the flowing direction of the insulating oil. That is, a duct piece extends between either ends of each winding. Therefore, the coil wet area is reduced, leading to degradation in the cooling efficiency. This necessitates the usage of a large-sized cooler having high cooling capability. Furthermore, the process of attaching the duct piece between each of the windings of the low-voltage and high-voltage windings is difficult.

In the transformer winding of Patent Document 2, oil is sedimented at the lower end in the axial direction of the transformer winding to which oil flows in, leading to higher temperature in the lower end region of the winding in the axial direction. In contrast, the temperature will become excessively low at the upper end in the axial direction of the transformer winding since the amount of oil flow increases at that region. Therefore, it will become necessary to employ a large-sized cooler having high cooling capability since the cooling efficiency is degraded.

In view of the foregoing, an object of the present invention is to provide a transformer device capable of improving the cooling efficiency with respect to a coil, and allowing reduction in size and fabrication cost.

Means for Solving the Problems

A transformer device according to an aspect of the present invention includes an iron core, a plurality of stacked coils wound onto the iron core, a plurality of base members disposed between the plurality of coils adjacent in the stacking direction, a plurality of flow channel member groups provided for each of the coils, each flow channel member group provided at a corresponding base member and forming a flow channel directed to a flow of an insulating liquid between the corresponding base member and a corresponding coil, and an obstruction member arranged to obstruct the flow of the insulating liquid such that at least one of the flow channels formed by the plurality of flow channel member groups differs in the flow volume of the insulating liquid from another of the flow channels, and to obstruct the flow of the insulating liquid at a region not overlapping with the iron core in the flowing direction of the insulating liquid, among the flow channels.

A transformer device according to another aspect of the present invention includes an iron core having at least two openings, a plurality of coils wound passing through each of the openings so as to be penetrated by a portion of the iron core located between each of the openings, and stacked in the penetrating direction, a plurality of base members arranged between the plurality of coils adjacent in the stacking direction, a plurality of flow channel member groups provided for each of the coils, each flow channel member group provided at a corresponding base member and forming a flow channel directed to a flow of an insulating liquid between the corresponding base member and a corresponding coil, and an obstruction member arranged to obstruct the flow of the insulating liquid such that at least one of the flow channels formed by the plurality of flow channel member groups differs in the flow volume of the insulating liquid from another of the flow channels.

Effects of the Invention

According to the present invention, the cooling efficiency with respect to the coil is improved, and the size and fabrication cost can be reduced.

DESCRIPTION OF THE REFERENCE SIGNS

Figure 1:
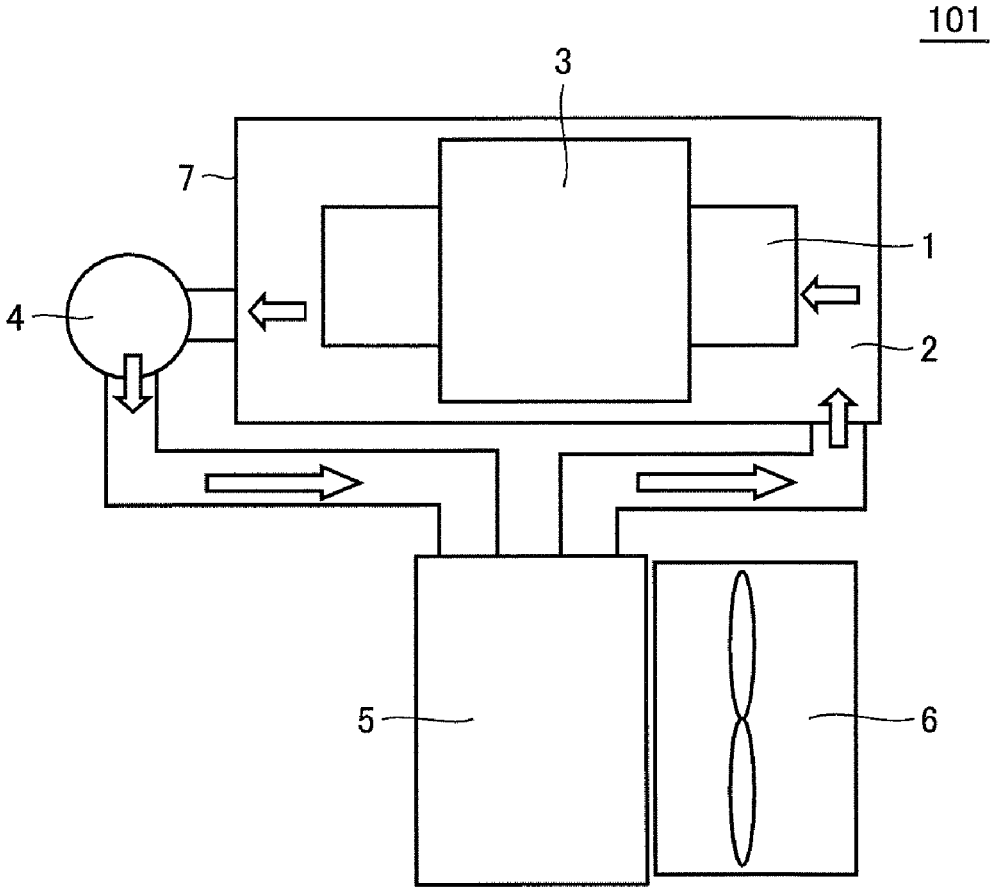
FIG. 1 represents a schematic configuration of a transformer device and the flow of an insulating liquid according to a first embodiment of the present invention.

1 coil portion; 2 insulating oil; 3 iron core; 4 pump; 5 cooler; 6 blower; 7 tank; 8 high-voltage coil group; 9, 10 low-voltage coil group; 8A, 8B high-voltage coil; 9A, 9B low-voltage coil; 10A, 10B low-voltage coil; 12, 22, 32, 42 obstruction member; 18A, 18B, 19A, 19B, 20A, 20B, 28, 30A, 30B, BE base member; 101 transformer device; W1, W2 window; BG flow channel member group; S1, S2 flow channel member.

BEST MODES FOR CARRYING OUT THE INVENTION

Embodiments of the present invention will be described hereinafter with reference to the drawings. In the drawings, the same or corresponding elements have the same reference character allotted, and description thereof will not be repeated.

First Embodiment

FIG. 1 represents a schematic configuration of a transformer device and the flow of an insulating liquid according to a first embodiment of the present invention.

Referring to FIG. 1, a transformer device 101 includes a coil portion 1, an insulating oil 2, an iron core 3, a pump 4, a cooler 5, a blower 6, and a tank 7.

Tank 7 is filled with insulating oil 2. Coil portion 1 and iron core 3 are placed in tank 7 to be immersed in insulating oil 2. Insulation and cooling of coil portion 1 and iron core 3 are effected by insulating oil 2.

As indicated by the arrow in FIG. 1, pump 4 causes circulation of insulating oil 2 sequentially through the pipe between pump 4 and cooler 5, cooler 5, the pipe between cooler 5 and tank 7, tank 7, and the pipe between tank 7 and pump 4.

Namely, pump 4 draws out insulating oil 2 through an outlet of tank 7 for delivery to cooler 5. Cooler 5 causes the passage of insulating oil 2 from pump 4 by cooling through the air flow from blower 6. Insulating oil 2 cooled by cooler 5 flows towards the inlet of tank 7 to cool coil portion 1 by passing through coil portion 1.

Figure 2:
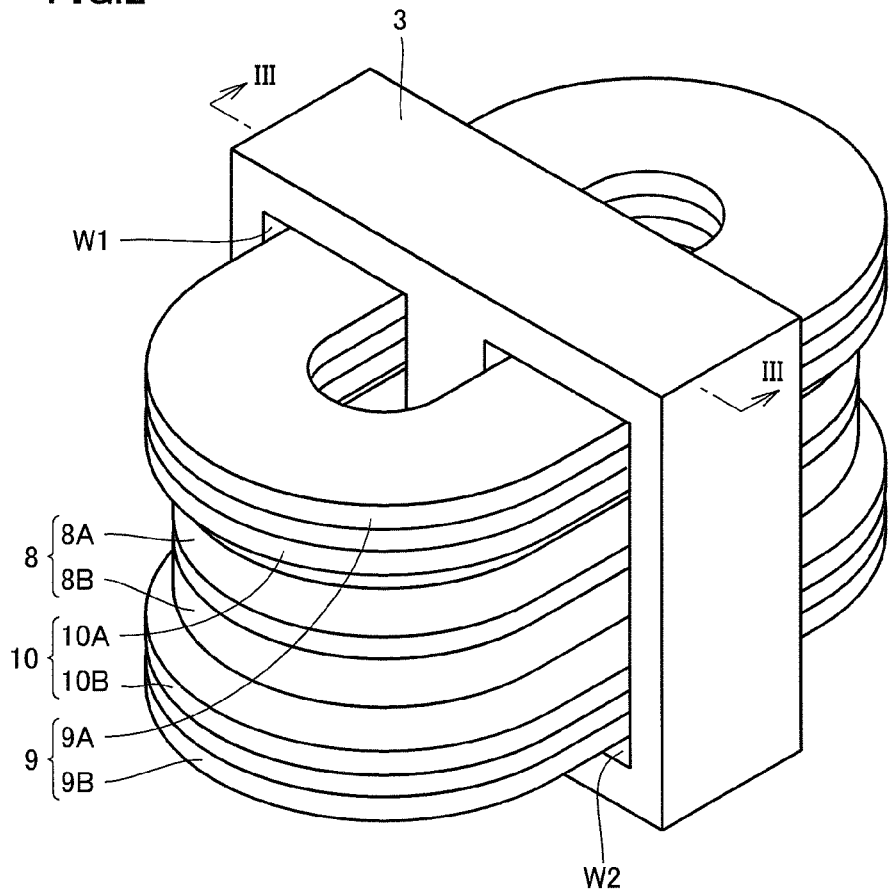
FIG. 2 is a perspective view schematically representing a configuration of a coil portion and iron core in the transformer device according to the first embodiment of the present invention.
Figure 3:
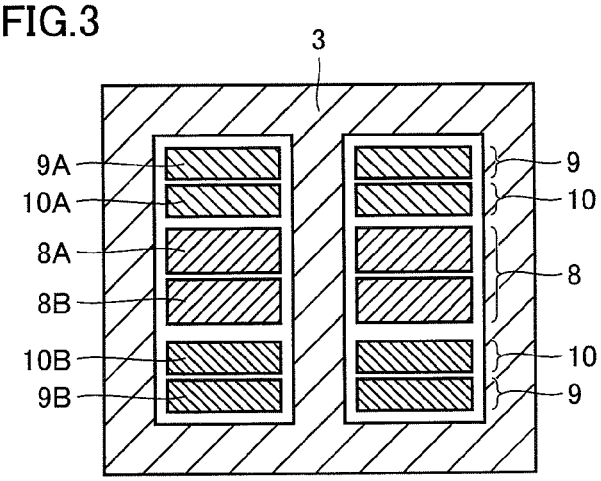
FIG. 3 is a sectional view of the coil portion and iron core taken along cross section of FIG. 2.

FIG. 2 is a perspective view schematically representing a configuration of the coil portion and iron core in the transformer device according to the first embodiment of the present invention. FIG. 3 is a sectional view of the coil portion and iron core taken along cross section of FIG. 2.

Referring to FIGS. 2 and 3, transformer device 101 is, for example, a shell-type transformer. Coil portion 1 includes a high-voltage coil group 8, and low-voltage coil groups 9, 10. High-voltage coil group 8 includes high-voltage coils 8A and 8B. Low-voltage coil group 9 includes low-voltage coils 9A and 9B. Low-voltage coil group 10 includes low-voltage coils 10A, 10B.

Iron core 3 includes first and second side faces opposite to each other, and windows W1 and W2 qualified as an opening, penetrating from the first side face to the second side face. High-voltage coils 8A and 8B, low-voltage coils 9A and 9B, and low-voltage coils 10A and 10B are wound passing through windows W1 and W2 so as to be penetrated by a portion of iron core 3 located between windows W1 and W2, and stacked in the penetrating direction of iron core 3.

High-voltage coils 8A and 8B, low-voltage coils 9A and 9B, and low-voltage coils 10A and 10B are wound to pass through windows W1 and W2.

High-voltage coil 8A is located between low-voltage coil 10A and low-voltage coil 10B, facing and magnetically coupled to low-voltage coil 10A.

High-voltage coil 8B is connected parallel to high-voltage coil 8A, located between low-voltage coil 10A and low-voltage coil 10B, facing and magnetically coupled to low-voltage coil 10B.

Low-voltage coil 9A is provided at a side opposite to high-voltage coil 8A about low-voltage coil 10A, and is magnetically coupled to high-voltage coil 8A.

Low-voltage coil 9B is provided at a side opposite to high-voltage coil 8B about low-voltage coil 10B, and is magnetically coupled to high-voltage coil 8B.

Figure 4:
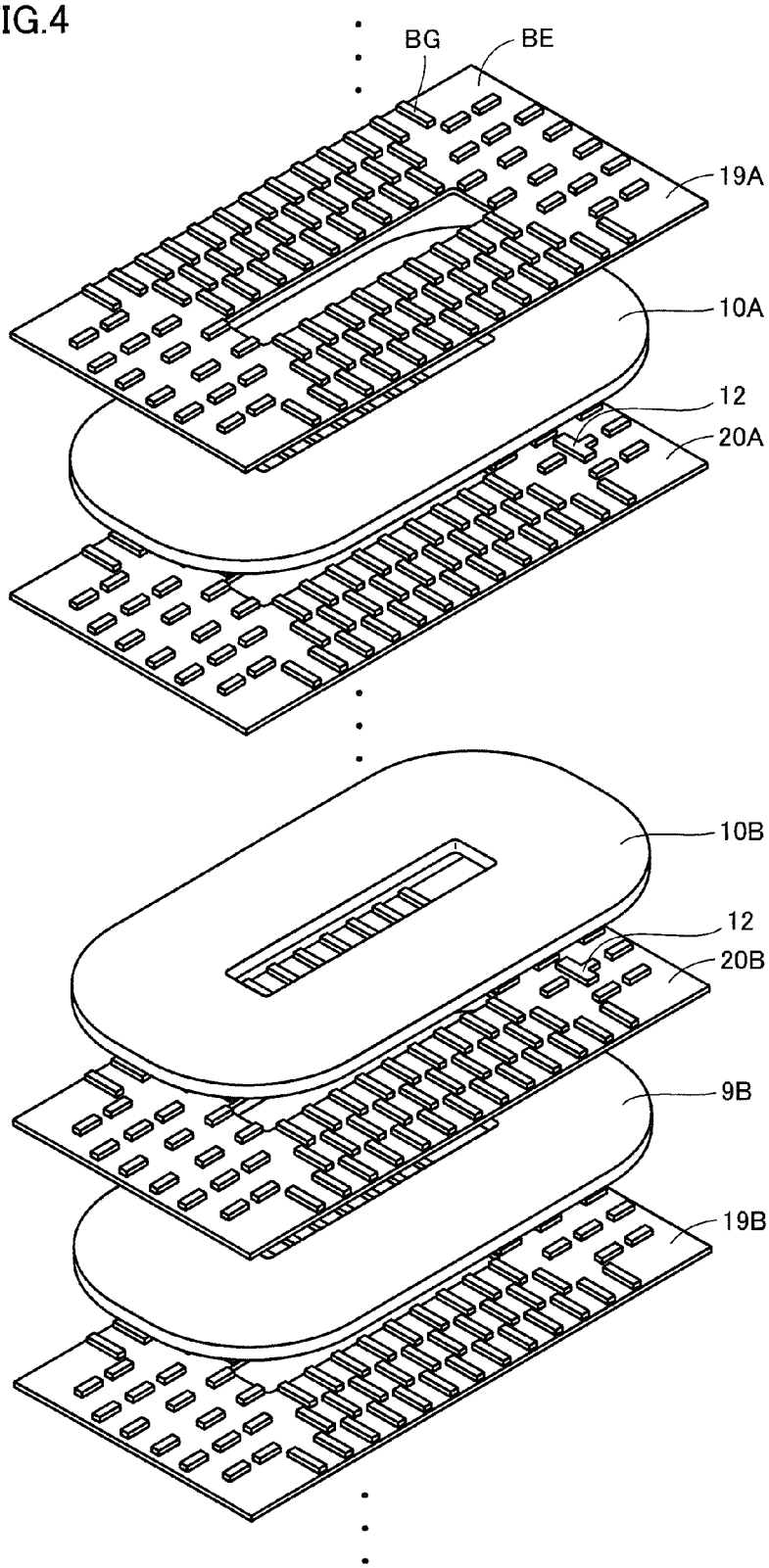
FIG. 4 is a perspective view representing in detail a configuration of the coil portion in the transformer device according to the first embodiment of the present invention.
Figure 5:
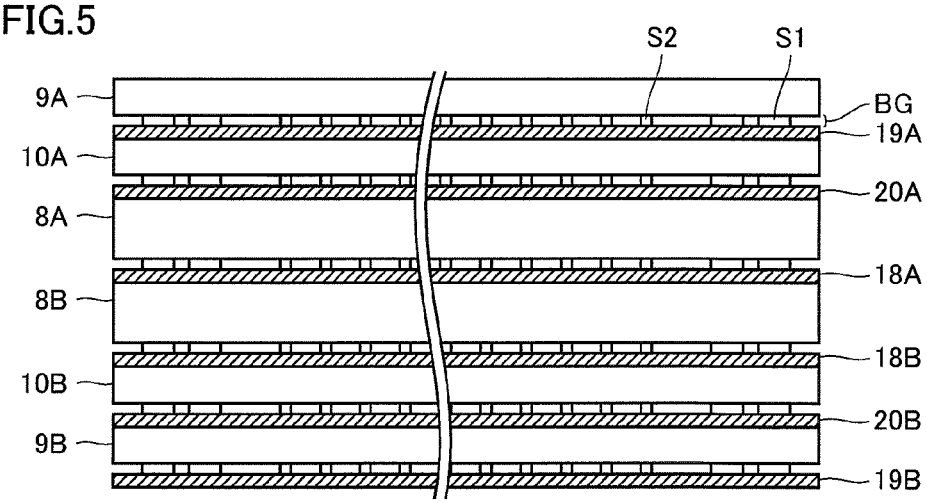
FIG. 5 is a sectional view representing in detail a configuration of the coil portion in the transformer device according to the first embodiment of the present invention.

FIG. 4 is a perspective view showing in detail a configuration of the coil portion in the transformer device according to the first embodiment of the present invention. FIG. 5 is a sectional view showing in detail the configuration of the coil portion in the transformer device according to the first embodiment of the present invention. FIG. 5 represents a coil portion 1 taken along cross section V-V in FIG. 6 or 7.

Referring to FIGS. 4 and 5, coil portion 1 includes a plurality of base members BE provided for each coil, i.e. base members 18A, 18B, 19A, 19B, 20A, and 20B. Base member BE is an insulation member. In FIG. 4, base members 19A, 19B, 20A and 20B corresponding to low-voltage coils 9A and 9B and low-voltage coils 10A and 10B, respectively, are shown, representative of base member BE.

Base member BE is arranged between coils adjacent in the stacking direction. The main surface of base member BE at a side opposite to the main surface where channel flow member group BG is provided adheres closely to a coil. Base member BE supports each coil.

More specifically, base member 19A is provided between low-voltage coil 9A and low-voltage coil 10A, and is in close contact with low-voltage coil 10A. Base member 20A is provided between low-voltage coil 10A and high-voltage coil 8A, and is in close contact with high-voltage coil 8A. Base member 18A is provided between high-voltage coil 8A and high-voltage coil 8B, and is in close contact with high-voltage coil 8B. Base member 18B is provided between high-voltage coil 8B and low-voltage coil 10B, and is in close contact with low-voltage coil 10B. Base member 20B is provided between low-voltage coil 10B and low-voltage coil 9B, and is in close contact with low-voltage coil 9B.

Flow channel member group BG is provided for each coil. Each flow channel member group BG includes a plurality of flow channel members that are insulation members, and provided at a corresponding base member BE to form a flow channel for the flow of insulating oil 2 between corresponding base member BE and a corresponding coil. Namely, flow channel member group BG provided at base members 18A, 18B, 19A, 19B, 20A, and 20B forms a flow channel for the cooling of high-voltage coil 8A, high-voltage coil 8B, low-voltage coil 9A, low-voltage coil 9B, low-voltage coil 10A, and low-voltage coil 10B. In order to support each coil, the flow channel member of each layer, i.e. the flow channel member at each base material BE, is arranged at a position substantially identical in the stacking layer direction of the coils.

Figure 6:
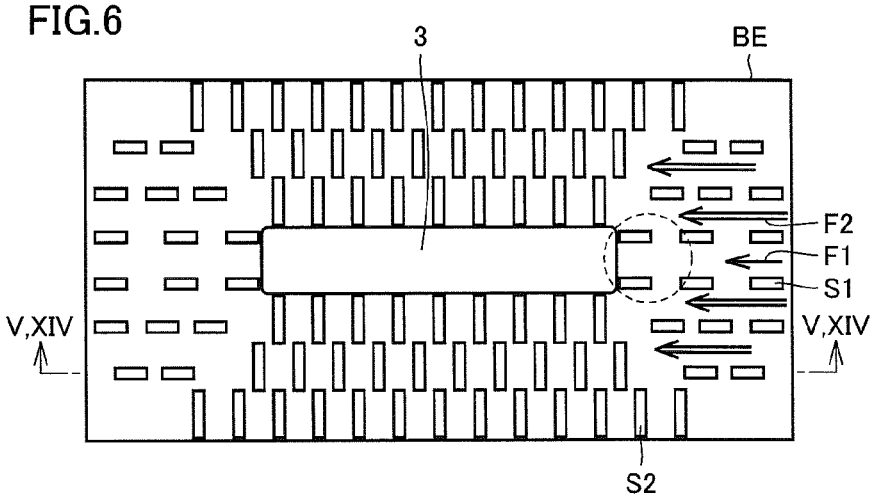
FIG. 6 represents the arrangement of flow channel members on the base member corresponding to a low-voltage coil group 10 in the transformer device according to the first embodiment of the present invention.

FIG. 6 represents an arrangement of flow channel members on a base member corresponding to low-voltage coil group 10 in the transformer device according to the first embodiment of the present invention.

According to FIG. 6, flow current member group BG includes a flow channel member S1 and a flow channel member S2. Flow channel member S1 is rectangular in shape. A plurality of flow channel members S1 are arranged extensively at the inlet side and outlet side of the flow channels. Flow channel member S1 includes two long sides along the flowing direction of insulating oil 2, and two shorter sides substantially perpendicular to the flowing direction of insulating oil 2. Flow channel member S2 is rectangular in shape. A plurality of flow channel members S2 are arranged extensively at the inlet side and outlet side of the flow channels. Flow channel member S2 includes two long sides substantially perpendicular to the flowing direction of insulating oil 2, and two shorter sides along the flowing direction of insulating oil 2.

Arrow F1 represents insulating oil 2 flowing at a region overlapping with iron core 3 in the flowing direction of insulating oil 2 at the flow channel inlet side region. Arrow F2 represents insulating oil 2 flowing at a region not overlapping with iron core 3 in the flowing direction of insulating oil 2 at the flow channel inlet side region.

At low-voltage coil group 10, insulating oil 2 indicated by arrow F1 collides against iron core 3 to be sedimented at the region encircled by a dotted line. Therefore, the flow volume of insulating oil 2 indicated by arrow F1 is lower as compared to the flow volume of insulating oil 2 indicated by arrow F2.

Figure 7:
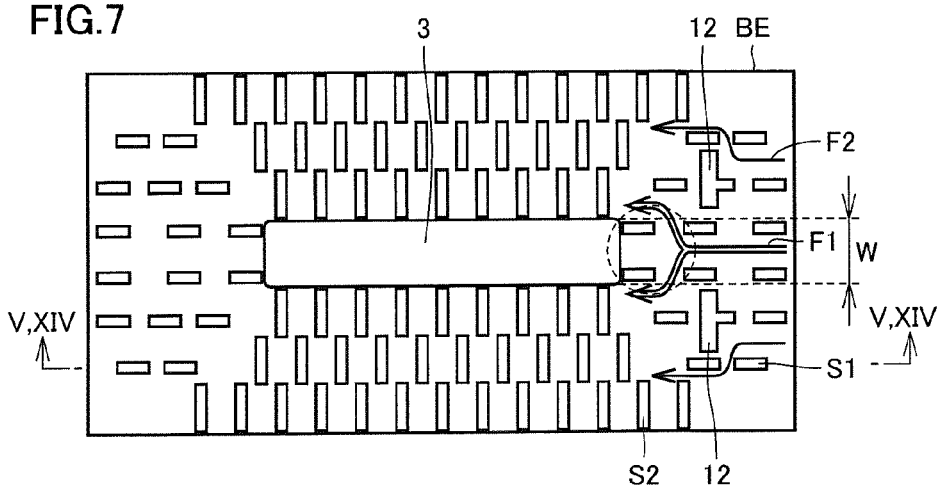
FIG. 7 represents the arrangement of flow channel members and obstruction members on the base member corresponding to a low-voltage coil group 9 in the transformer device according to the first embodiment of the present invention.

FIG. 7 represents the arrangement of the flow channel members and obstruction members on the base member corresponding to low-voltage coil group 9 in the transformer device according to the first embodiment of the present invention.

Referring to FIG. 7, base member BE having formed a flow channel for cooling low-voltage coil group 9 differs from base member BE having formed the flow channel to cool low-voltage coil group 10 in that an obstruction member 12 is provided, in addition to flow channel member S1 and flow channel member S2. Obstruction member 12 takes a T-shape having a portion in a direction substantially perpendicular to the flowing direction of insulating oil 2 longer than the length of the two shorter sides of flow channel member S1. Obstruction member 12 is arranged to obstruct the flow of insulating oil 2 at an inlet side region of the flow channels formed by flow channel member group BG, not overlapping with iron core 3 in the flowing direction of insulating oil 2.

The case where transformer device 101 has an AC mode in which AC voltage is supplied from an overhead line or the like to a high-voltage coil, whereby AC voltage is induced at the low-voltage coil, and a DC mode in which DC voltage is supplied from an overhead line or the like to a low-voltage coil will be described hereinafter.

Figure 8:
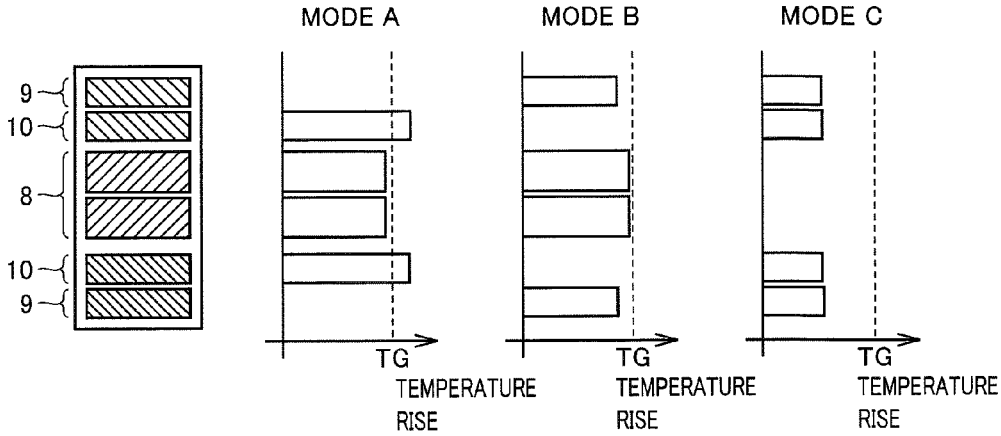
FIG. 8 represents the temperature rise of each coil in each operation mode assuming that the transformer device is absent of an obstruction member.

FIG. 8 represents the temperature rise of each coil in each operation mode assuming that the transformer device is absent of an obstruction member.

In an operation mode A that is an AC mode, AC voltage having an amplitude of 15 kV, for example, is supplied to high-voltage coil group 8 from an overhead line or the like, whereby AC voltage is induced at low-voltage coil group 10.

Similarly, in an operation mode B that is an AC mode, AC voltage of 25 kV, for example, in amplitude is supplied from an overhead line or the like to high-voltage coil group 8, whereby AC voltage is induced at low-voltage coil group 9.

At an operation mode C that is a DC mode, DC voltage is supplied from an overhead line or the like to low-voltage coil groups 9 and 10.

Referring to FIG. 8, the temperature rise of low-voltage coil group 10 corresponding to operation mode A is greatest among operation modes A, B and C. Here, the temperature rise value of low-voltage coil group 10 exceeds a reference value TG.

Therefore, in the case where transformer device 101 is absent of obstruction member 12, the cooling design will be defined by low-voltage coil group 10 that is a portion of the coil in transformer device 101, necessitating the usage of a large-sized cooler of high cooling capability. This means that the transformer device will be increased in size and fabrication cost.

Figure 9:
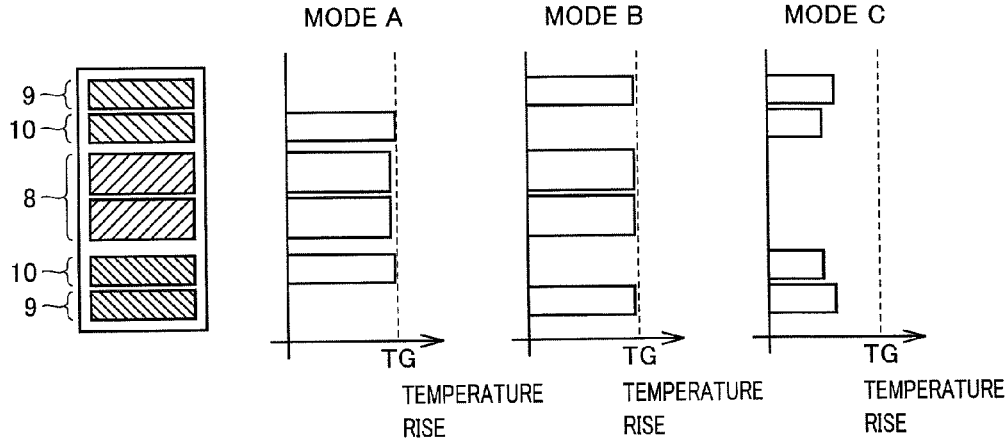
FIG. 9 represents the temperature rise of each coil at each operation mode of the transformer device according to the first embodiment of the present invention.

FIG. 9 represents the temperature rise of each coil at each operation mode of the transformer device according to the first embodiment of the present invention.

Transformer device 101 has obstruction member 12 provided at a base member BE having formed a flow channel corresponding to low-voltage coil group 9, i.e. a flow channel directed to cooling low-voltage coil group 9.

Accordingly, the pressure loss at low-voltage coil group 9 increases, so that the flow volume of insulating oil 2 at the flow channel directed to cooling low-voltage coil group 9 is reduced. Therefore, the flow volume, i.e. the flow rate, of insulating oil 2 at the flow channel directed to cooling low-voltage coil group 10 located adjacent to low-voltage coil group 9 is increased. Thus, the temperature rise of low-voltage coil group 9 becomes larger, and the temperature increase of low-voltage coil group 10 becomes smaller.

Therefore, as shown in FIG. 9, the temperature rise of low-voltage coil groups 9 and 10 are equalized. In other words, the temperature rise value of low-voltage coil group 10 at operation mode A can be prevented from exceeding reference value TG. Although transformer device 101 has a larger temperature rise of low-voltage coil group 9 in operation mode B, as compared to the case where obstruction member 12 is not provided, this increase is suppressed lower than reference value TG. The temperature of each coil in the AC mode and DC mode is suppressed lower than or equal to a predetermined value.

In the transformer device according to the first embodiment of the present invention, the temperature rise between each of the coil groups is equalized to improve the cooling efficiency by adjusting the pressure loss of each coil group, increasing the flow volume of the insulating oil towards a coil group of high temperature to suppress temperature rise thereof, and reducing the flow volume of the insulating oil towards to a coil group of low temperature to increase temperature rise thereof.

The coil cooling capability is proportional to the flow rate of the insulating oil in contact with the coil, and the wet area of the coil in contact with the insulating oil. In the transformer device according to the first embodiment of the present invention, balance in the flow volume between respective coil groups can be established while ensuring the coil wet area.

The coil temperature is obtained by adding up the ambient temperature, the insulating oil temperature, and the coil temperature rise value by the insulating oil. Since the coil temperature has the upper limit determined by the specification, unequalization in the coil temperature rise value between the coil groups will necessitate selection of a cooler corresponding to the maximum value of the coil temperature rise value, causing the usage of a large-sized cooler in order to improve the cooling capability.

Since the coil temperature rise can be equalized between each coil group in the transformer device according to the first embodiment of the present invention, it will no longer be necessary to use a cooler of high cooling capability. Therefore, the entire transformer device can be reduced in size and weight to allow reduction in the fabrication cost. Further, the temperature rise between coil groups can be equalized effectively without having to change the function design of the vehicle transformer.

At low-voltage coil group 9, the flow volume of insulating oil 2 at the region not overlapping with iron core 3 in the insulating oil flowing direction is reduced where as the flow volume of insulating oil 2 at the region overlapping with iron core 3 in the insulating oil flowing direction is increased. Accordingly, the flow volume of insulating oil 2 indicated by arrow F1 is increased, whereas the flow volume of insulating oil 2 indicated by arrow F2 is reduced, as shown in FIG. 7. Thus, the flow volume of the insulating oil towards the region where insulating oil 2 collides against iron core 3 to be sedimented is increased, allowing reduction in this sediment region. In other words, the cooling efficiency can be further improved by preventing variation in the temperature rise within low-voltage coil group 9, in addition to equalization of the coil temperature rise between the coil groups.

In the case where a secondary winding and tertiary winding, for example, are connected with respective corresponding voltage converters in a vehicle transformer, it is required to keep in phase the operation of each motor driven by each voltage converter. Therefore, the short-circuit impedance between the primary winding and secondary winding, and the short-circuit impedance between the primary winding and tertiary winding must be equalized to the best possible degree.

The vehicle transformer disclosed in Patent Document 1 is a core type transformer, having a concentric structure with the secondary winding and tertiary winding arranged at the inner side of the high-voltage winding (primary winding). Since the radial distance of the secondary winding and tertiary winding differ in the vehicle transformer of Patent Document 1, and the short-circuit impedance value is proportional to the radial distance from the center of the winding concentric circle, it is difficult to set the short-circuit impedance equal.

The duct piece interval is set such that each coil can withstand the mechanical force generated by the magnetic field. If the duct piece corresponding to one of the secondary winding and tertiary winding is set to take a high height in order to render the short-circuit impedance of the secondary winding and tertiary winding equal in the vehicle transformer of Patent Document 1, the flow volume of the insulating oil in contact with that corresponding winding will be increased. Accordingly, it will be necessary to render the arrangement interval of the duct piece corresponding to that winding smaller. However, this will lead to degradation in the heat transfer coefficient since the wet area contact between the winding and the insulating oil is reduced.

The winding of the transformer disclosed in Patent Document 2 corresponding to a core type indicates a problem similar to that of the vehicle transformer of Patent Document 1.

However, the transformer device according to the first embodiment of the present invention is a shell-type transformer having a configuration in which the high-voltage coil (primary coil) is sandwiched between respective low-voltage coils (secondary winding and tertiary winding). Accordingly, the positional relationship between the high-voltage coil and each of the low-voltage coils can be set equal, facilitating equalization of the short-circuit impedance.

The vehicle transformer device according to the first embodiment of the present invention is described as, but not limited to, a shell-type transformer, and may be a core-type instead. In this case, the high-voltage coil and low-voltage coils are wound concentrically around iron core 3 to be stacked in the radial direction of the winding circle. Base member BE is disposed between the plurality of coils adjacent in the radial direction, i.e. the stacking direction.

The transformer device according to the first embodiment of the present invention is described based on, but not limited to, a configuration in which obstruction member 12 is arranged at a position obstructing the flow of insulating oil 2 such that the flow volume of insulating oil 2 at the flow channel directed to cooling low-voltage coil group 9 is smaller than the flow volume of insulating oil 2 at the flow channel directed to cooling low-voltage coil group 10. Any configuration in which obstruction member 12 is arranged at a site such that at least one of the flow channels formed by the plurality of flow channel member groups BG differs in the flow volume of insulating oil 2 from another flow channel, according to the required specification of the transformer device.

Furthermore, the transformer device according to the first embodiment of the present invention is described based on, but not limited to, a configuration in which two sets of coil groups, i.e. low-voltage coil groups 9 and 10, are provided. A further increase in the combination of the sets of coil can be accommodated by arranging an obstruction member 12 appropriately, allowing a similar advantage.

Moreover, the vehicle with transformer device 101 is not limited to a vehicle that runs in an AC zone and a DC zone. In the case where the vehicle runs in a plurality of zones where AC voltages differing in amplitude, for example, are supplied, the temperature rise between each of the coil groups can be equalized to improve the cooling efficiency.

Another embodiment of the present invention will be described hereinafter with reference to the drawings. In the drawings, the same or corresponding elements have the same reference character allotted, and description thereof will not be repeated.

Second Embodiment

The present embodiment relates to a transformer device having the shape of the obstruction member modified as compared to that of the transformer device of the first embodiment. Elements other than those described below are similar to those of the transformer device of the first embodiment.

Figure 10:
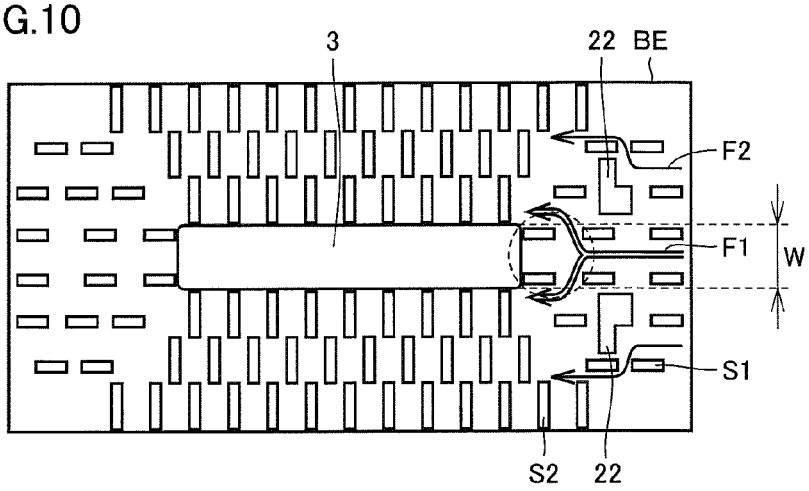
FIG. 10 represents the arrangement of flow channel members and obstruction members on the base member corresponding to low-voltage coil group 9 in the transformer device according to the second embodiment of the present invention.

FIG. 10 represents the arrangement of the flow channel members and obstruction members on the base member corresponding to low-voltage coil group 9 in the transformer device according to the second embodiment of the present invention.

Referring to FIG. 10, the transformer device according to the second embodiment of the present invention includes an obstruction member 22, instead of obstruction member 12, as compared to the transformer device according to the first embodiment of the present invention.

At base member BE having formed a flow channel directed to cooling low-voltage coil group 9, an obstruction member 22 is provided, in addition to flow channel member S1 and flow channel member S2, differing from base member BE having formed a flow channel directed to cooling low-voltage coil group 10. Obstruction member 22 takes an L shape, and has a portion in a direction substantially perpendicular to the flowing direction of insulating oil 2, longer than the length of the two shorter sides of flow channel member S1. Obstruction member 22 is arranged to obstruct the flow of insulating oil 2 at an inlet side region of the flow channels formed by flow channel member group BG, not overlapping with iron core 3 in the flowing direction of insulating oil 2.

The remaining structure and operation are similar to those of the transformer device of the first embodiment, and detailed description thereof will not be repeated.

Thus, since the transformer device according to the second embodiment of the present invention can equalize the temperature rise between the coil groups, the cooler can be reduced in size, allowing reduction in the size and weight of the entire transformer device to reduce the fabrication cost, likewise with the transformer device according to the first embodiment of the present invention.

The obstruction member is not limited to a T shape or L shape. An advantage similar to that of the transformer device according to the first embodiment of the present invention can be achieved as long as the obstruction member is shaped having a portion in a direction substantially perpendicular to the flowing direction of insulating oil 2, longer than the length of the two shorter sides of flow channel member S1.

Another embodiment of the present invention will be described hereinafter with reference to the drawings. In the drawings, the same or corresponding elements have the same reference character allotted, and description thereof will not be repeated.

Third Embodiment

The present embodiment relates to a transformer device having the arrangement of the obstruction member modified, as compared to that of the transformer device according to the first embodiment. Elements other than those described below are similar to those of the transformer device of the first embodiment.

Figure 11:
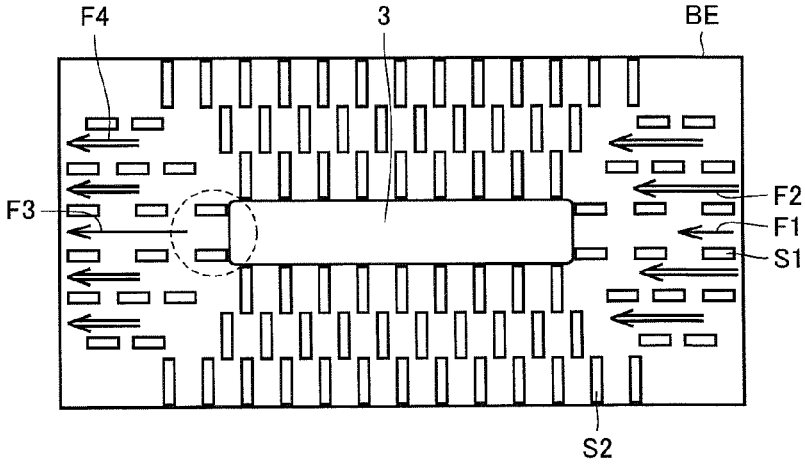
FIG. 11 represents the arrangement of the flow channel members on the base member corresponding to low-voltage coil group 10 in the transformer device according to a third embodiment of the present invention.

FIG. 11 represents the arrangement of the flow channel members on the base member corresponding to low-voltage coil group 10 in the transformer device according to a third embodiment of the present invention.

Referring to FIG. 11, arrow F3 represents insulating oil 2 flowing through a region overlapping with iron core 3 in the flowing direction of insulating oil 2 at the outlet side region of the flow channels. Arrow F4 represents insulating oil 2 flowing through a region not overlapping with iron core 3 in the flowing direction of insulating oil 2 at the outlet side region of the flow channels.

At low-voltage coil group 10, insulating oil 2 indicated by arrow F3 will be sedimented by iron core 3 at the region encircled by a dotted line. Therefore, the flow volume of insulating oil 2 indicated by arrow F3 is smaller than the flow volume of insulating oil 2 indicated by arrow F4.

Figure 12:
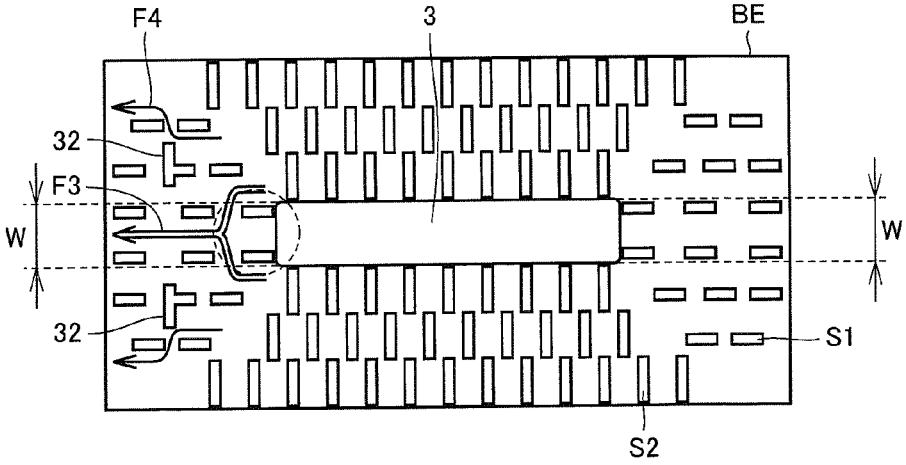
FIG. 12 represents the arrangement of flow channel members and obstruction members on the base member corresponding to low-voltage coil group 9 in the transformer device according to the third embodiment of the present invention.

FIG. 12 represents the arrangement of flow channel members and obstruction members on the base member corresponding to low-voltage coil group 9 in the transformer device according to the third embodiment of the present invention.

Referring to FIG. 12, the transformer device according to the third embodiment of the present invention includes an obstruction member 32, instead of obstruction member 12, as compared to the transformer device according to the first embodiment of the present invention.

At base member BE having formed a flow channel directed to cooling low-voltage coil group 9, an obstruction member 32 is provided, in addition to flow channel member S1 and flow channel member S2, differing from base member BE having formed a flow channel directed to cooling low-voltage coil group 10. Obstruction member 32 takes a T shape, having a portion in a direction substantially perpendicular to the flowing direction of insulating oil 2, longer than the length of the two shorter sides of flow channel member S1. Obstruction member 32 is arranged to obstruct the flow of insulating oil 2 at an outlet side region of the flow channels formed by flow channel member group BG, not overlapping with iron core 3 in the flowing direction of insulating oil 2.

The remaining structure and operation are similar to those of the transformer device of the first embodiment, and detailed description thereof will not be repeated.

Thus, since the transformer device according to the third embodiment of the present invention can equalize the temperature rise between the coil groups, the cooler can be reduced in size, allowing reduction in the size and weight of the entire transformer device to reduce the fabrication cost, likewise with the transformer device according to the first embodiment of the present invention.

In the transformer device according to the third embodiment invention, the flow volume of insulating oil 2 at a region not overlapping with iron core 3 in the insulating oil flowing direction is reduced whereas the flow volume of insulating oil 2 at the region overlapping with iron core 3 in the insulating oil flowing direction is increased at low-voltage coil group 9, likewise with the transformer device according to the first embodiment of the present invention. Accordingly, the flow volume of insulating oil 2 indicated by arrow F3 is increased, whereas the flow volume of insulating oil 2 indicated by arrow F4 is reduced, as shown in FIG. 12. Accordingly, the flow volume of the insulating liquid towards the region where insulating oil 2 collides against iron core 3 to be sedimented can be increased, allowing this sediment region to be reduced. Therefore, variation in the temperature rise in low-voltage coil group 9 can be prevented.

The obstruction member can be provided at both the inlet side and outlet side of the flow channels. By such a configuration, the cooling efficiency of the unitary coil can be further improved, as compared to the transformer device of the first embodiment and third embodiment of the present invention.

Another embodiment of the present invention will be described hereinafter with reference to the drawings. In the drawings, the same or corresponding elements have the same reference character allotted, and description thereof will not be repeated.

Fourth Embodiment

The present embodiment relates to a transformer device having the arrangement of the obstruction member modified, as compared to that of the transformer device of the first embodiment. Elements other than those described below are similar to those of the transformer device of the first embodiment.

Figure 13:
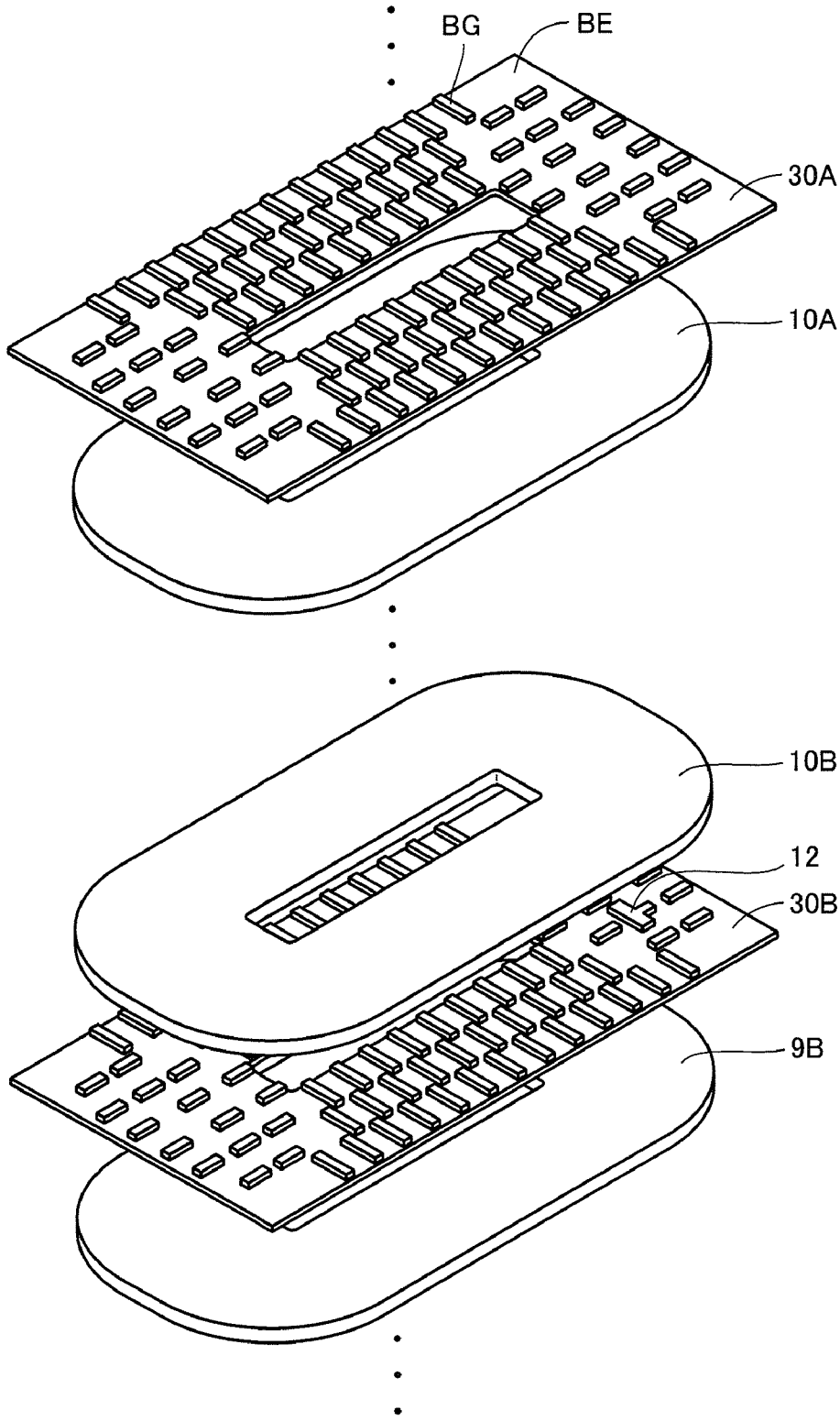
FIG. 13 is a perspective view showing in detail a configuration of a coil portion in a transformer device according to a fourth embodiment of the present invention.
Figure 14:
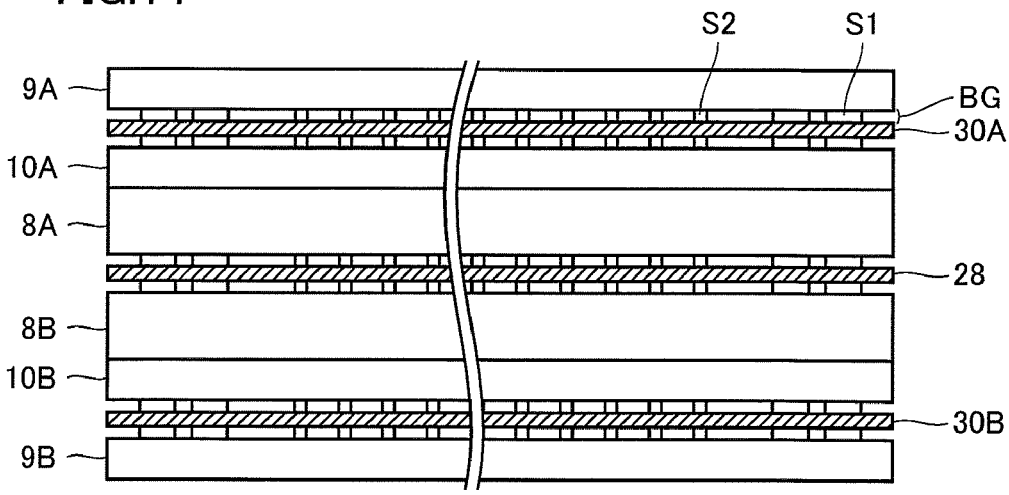
FIG. 14 is a sectional view representing in detail a configuration of the coil portion in the transformer device according to the fourth embodiment of the present invention.

FIG. 13 is a perspective view showing in detail a configuration of a coil portion in a transformer device according to a fourth embodiment of the present invention. FIG. 14 is a sectional view representing in detail a configuration of the coil portion at the transformer device according to the fourth embodiment of the present invention. FIG. 14 represents a XIV-XIV cross section of FIG. 6 or FIG. 7 of coil portion 1.

Referring to FIGS. 13 and 14, coil portion 1 includes base members 28, 30A and 30B. In FIG. 13, base member 30A corresponding to low-voltage coils 9A and 10A, and base member 30B corresponding to low-voltage coils 9B and 10B are indicated representative thereof.

Base member BE is arranged between coils adjacent in the stacking direction. Base member BE supports each coil via flow channel member group BG.

More specifically, base member 30A is provided between low-voltage coil 9A and low-voltage coil 10A. Base member 28 is provided between high-voltage coil 8A and high-voltage coil 8B. Base member 20B is provided between low-voltage coil 10B and low-voltage coil 9B.

Flow channel member group BG is provided for each coil. Flow channel member group BG includes a plurality of flow channel members each of an insulating member, and provided at a corresponding base member BE, forming flow channels directed to conduct flow of insulating oil 2 between a corresponding base member BE and corresponding coil. Specifically, flow channel member group BG provided at the main surface of base member 30A corresponding to the side of low-voltage coil 9A and at the main surface of base member 30A corresponding to the side of low-voltage coil 10A forms flow channels directed to cooling low-voltage coil 9A and low-voltage coil 10A, respectively. Flow current member group BG provided at the main surface of base member 28 corresponding to the side of high-voltage coil 8A and the main surface of base member 28 corresponding to the side of high-voltage coil 8B forms flow channels directed to cooling high-voltage coil 8A and high-voltage coil 8B, respectively. Flow channel member group BG provided at the main surface of base member 30B corresponding to the side of low-voltage coil 9B and the main surface of base member 30B corresponding to the side of low-voltage coil 10B forms flow channels directed to cooling low-voltage coil 9B and low-voltage coil 10B, respectively. In order to support each coil, the flow channel members of each layer, i.e. the flow channel members of each base member BE, are arranged at a position substantially identical in the coil stacking direction.

The remaining structure and operation are similar to those of the transformer device of the first embodiment, and detailed description thereof will not be repeated. Thus, since the transformer device according to the fourth embodiment of the present invention can equalize the temperature rise between the coil groups, the cooler can be reduced in size, allowing reduction in the size and weight of the entire transformer device to reduce the fabrication cost, likewise with the transformer device according to the first embodiment of the present invention.

Furthermore, since the base members can be reduced as compared to the transformer device according to the first embodiment of the present invention, the size and fabrication cost can be further reduced.

Another embodiment of the present invention will be described hereinafter with reference to the drawings. In the drawings, the same or corresponding elements have the same reference character allotted, and description thereof will not be repeated.

Fifth Embodiment

The present embodiment relates to a transformer device having the arrangement of the obstruction members modified, as compared to that of the transformer device according to the first embodiment. Elements other than these described below are similar to those of the transformer device of the first embodiment.

Although the transformer device according to the first embodiment of the present invention has the obstruction members arranged on the main surface of the base member, the present invention is not limited thereto. The obstruction members may be arranged outer of the base member, or attached at the end of the base member, as set forth below.

Figure 15:
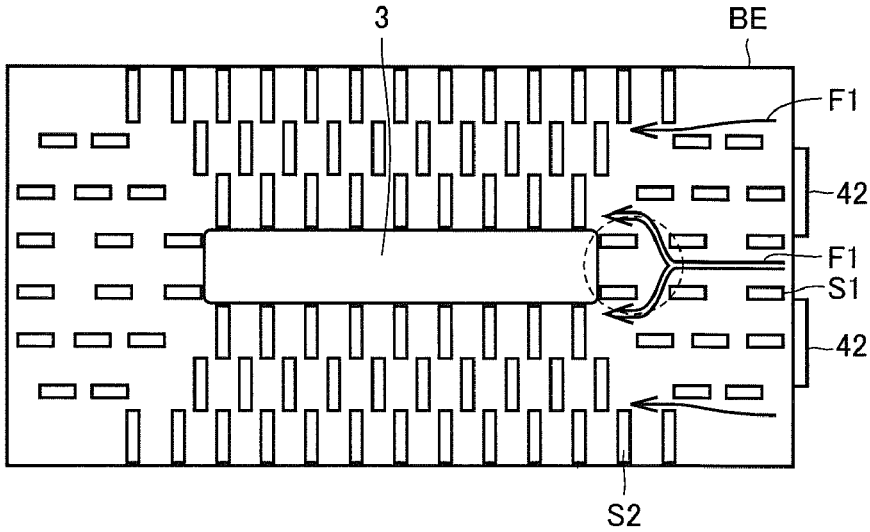
FIG. 15 represents the arrangement of flow channel members and obstruction members on the base member corresponding to low-voltage coil group 9 in a transformer device according to a fifth embodiment of the present invention.

FIG. 15 represents the arrangement of flow channel members and obstruction members at the base member corresponding to low-voltage coil group 9 in the transformer device according to a fifth embodiment of the present invention.

Referring to FIG. 15, the transformer device according to the fifth embodiment of the present invention includes an obstruction member 42, instead of obstruction member 12, as compared to the transformer device according to the first embodiment of the present invention.

At the end of base member BE having formed a flow channel directed to cooling low-voltage coil group 9, there is attached an obstruction member 42, differing from base member BE having formed a flow channel directed to cooling low-voltage coil group 10. Obstruction member 42 is arranged to obstruct the flow of insulating oil 2 at an inlet side region of the flow channels formed by flow channel member group BG, not overlapping with iron core 3 in the flowing direction of insulating oil 2. In other words, obstruction member 42 has a portion in a direction substantially perpendicular to the flowing direction of insulating oil 2, longer than the length of the two shorter sides of flow channel member S1.

The remaining structure and operation are similar to those of the transformer device of the first embodiment, and detailed description thereof will not be repeated.

Since the pressure loss of low-voltage coil group 9 is increased and the volume flow of insulating oil 2 at the flow channel directed to cooling low-voltage coil group 9 is reduced according to the configuration set forth above, the flow volume, i.e. flow rate, of insulating oil 2 at the flow channel directed to cooling low-voltage coil group 10 located adjacent to low-voltage coil group 9 is increased. Accordingly, the temperature rise at low-voltage coil group 9 is increased, whereas the temperature rise at low-voltage coil group 10 is reduced. Therefore, the temperature rise of low-voltage coil groups 9 and 10 are equalized.

Thus, since the transformer device according to the fifth embodiment of the present invention can equalize the temperature rise between the coil groups, the cooler can be reduced in size, allowing reduction in the size and weight of the entire transformer device to reduce the fabrication cost, likewise with the transformer device according to the first embodiment of the present invention.

In the transformer device according to the fifth embodiment of the present invention, the flow volume of insulating oil 2 at a region not overlapping with iron core 3 in the insulating oil flowing direction is reduced whereas the flow volume of insulating oil 2 at a region overlapping with iron core 3 in the insulating oil flowing direction is increased at low-voltage coil group 9, likewise with the transformer device according to the first embodiment of the present invention. Accordingly, the flow volume of insulating oil 2 indicated by arrow F1 is increased, whereas the flow volume of insulating oil 2 indicated by arrow F2 is reduced, as shown in FIG. 15. Accordingly, the flow volume of the insulating liquid towards the region where insulating oil 2 collides against iron core 3 to be sedimented can be increased, allowing this sediment region to be reduced. Therefore, variation in the temperature rise in low-voltage coil group 9 can be prevented.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. A transformer device comprising:

an iron core;

a plurality of coils wound onto said iron core and stacked with each other;

a plurality of base members arranged corresponding to said plurality of coils, respectively;

a plurality of flow channel member groups provided for said plurality of base members, respectively, and each forming a flow channel directed to a flow of an insulating fluid between a corresponding base member and a corresponding coil; and an obstruction member arranged to obstruct the flow of said insulating fluid such that at least one of the flow channels formed by said plurality of flow channel member groups differs in a flow volume of said insulating fluid from another of said flow channels, and to obstruct the flow of said insulating fluid at a region not overlapping with said iron core in a flowing direction of said insulating fluid among regions of said at least one of the flow channels, wherein said channel flow member group includes a plurality of first flow channel members of a rectangular shape, provided extensively at an inlet side and outlet side of said flow channels, each having two long sides along the flowing direction of said insulating fluid, and two shorter sides substantially perpendicular to the flowing direction of said insulating fluid, and a plurality of second flow channel members of a rectangular shape, provided extensively between the inlet side and outlet side of said flow channels, each having two long sides substantially perpendicular to the flowing direction of said insulating fluid and two shorter sides along the flowing direction of said insulating fluid, and said obstruction member provided at least one of the inlet side and outlet side of said flow channels, and having a portion in a direction substantially perpendicular to the flowing direction of said insulating fluid longer than a length of the two shorter sides of said first flow channel member.

2. The transformer device according to claim 1, wherein said obstruction member is arranged to obstruct the flow of said insulating fluid at an inlet side region of said at least one of the flow channels, not overlapping with said iron core in the flowing direction of said insulating fluid.

3. The transformer device according to claim 1, wherein said obstruction member is arranged to obstruct the flow of said insulating fluid at an outlet side region of said at least one of the flow channels, not overlapping with said iron core in the flowing direction of said insulating fluid.

4. The transformer device according to claim 1, wherein said obstruction member has a T shape or an L shape.

5. The transformer device according to claim 1, wherein said plurality of coils include a low-voltage coil and a high-voltage coil, said at least one of the flow channels corresponds to said low-voltage coil.

6. The transformer device according to claim 1, wherein said plurality of coils include a low-voltage coil and a high-voltage coil, said transformer device including an AC mode in which externally applied AC voltage is supplied to said high-voltage coil, and AC voltage is induced at said low-voltage coil by the AC voltage supplied to said high-voltage coil, and a DC mode in which externally applied DC voltage is supplied to said low-voltage coil, wherein said obstruction member is provided at a position obstructing the flow of said insulating fluid such that a temperature of said high-voltage coil and said low-voltage coil in said AC mode and said DC mode is lower than a predetermined value.

7. The transformer device according to claim 1, further comprising:

a tank filled with said insulating fluid and containing said plurality of coils, said iron core, said base members, said plurality of flow channel member groups and said obstruction member to immerse said plurality of coils, said iron core, said plurality of base members, said plurality of flow channel member groups and said obstruction member in said insulating fluid;

a cooler cooling said insulating fluid; and a pump circulating said insulating fluid between said tank and said cooler.

8. The transformer device according to claim 1, wherein said iron core includes at least two openings, and said plurality of coils are wound passing through each of said openings so as to be penetrated by a portion of said iron core located between each of said openings, and stacked in said penetrating direction.

9. The transformer device according to claim 1, wherein said obstruction member is provided at at least one of said plurality of base members.

10. A transformer device comprising:

an iron core including at least two openings;

a plurality of coils wound passing through each of said openings so as to be penetrated by a portion of said the iron core located between each of said openings, and stacked in said penetrating direction;

a plurality of base members arranged corresponding to said plurality of coils, respectively;

a plurality of flow channel member groups provided for said plurality of base members, respectively, and each forming a flow channel directed to a flow of an insulating fluid between a corresponding base member and a corresponding coil; and an obstruction member arranged to obstruct the flow of said insulating fluid such that at least one of the flow channels formed by said plurality of flow channel member groups differs in a flow volume of said insulating fluid from another of said flow channels, wherein said channel flow member group includes a plurality of first flow channel members of a rectangular shape, provided extensively at an inlet side and outlet side of said flow channels, each having two long sides along the flowing direction of said insulating fluid, and two shorter sides substantially perpendicular to the flowing direction of said insulating fluid, and a plurality of second flow channel members of a rectangular shape, provided extensively between the inlet side and outlet side of said flow channels, each having two long sides substantially perpendicular to the flowing direction of said insulating fluid and two shorter sides along the flowing direction of said insulating fluid, and said obstruction member provided at least one of the inlet side and outlet side of said at least one of the flow channels, and having a portion in a direction substantially perpendicular to the flowing direction of said insulating fluid longer than a length of the two shorter sides of said first flow channel member.

* * * * *